US005648752A

United States Patent [19]

Alfrey

[11] Patent Number: 5,648,752

[45] Date of Patent: Jul. 15, 1997

[54] DART GAME ELECTRONIC SCOREKEEPING DEVICE

[76] Inventor: Kip R. Alfrey, 824 Pricewood Ct., Anderson, Ind. 46013

[21] Appl. No.: 500,107

[22] Filed: Jul. 10, 1995

[51] Int. Cl.[6] ..... G08B 23/00; F41J 5/00

[52] U.S. Cl. ..... 340/323 R; 364/411; 273/371; 273/372; 273/376; 273/DIG. 26

[58] Field of Search ..... 340/323 R; 364/410, 364/411; 273/371–376, 401, DIG. 26

[56] References Cited

U.S. PATENT DOCUMENTS

| | | | |
|---|---|---|---|
| 4,216,968 | 8/1980 | Yeeda | 273/376 |
| 4,561,660 | 12/1985 | Zammuto | 273/376 |
| 4,567,461 | 1/1986 | Honekman et al. | 340/323 R |
| 5,384,561 | 1/1995 | Smith | 340/323 R |

*Primary Examiner*—Donnie L. Crosland

[57] ABSTRACT

A dart game electronic scorekeeping device including a case. The case has an upper surface and a periphery formed of a pair of opposed side edges, an upper edge, and a lower edge. A game switch selection mechanism is extended through the case for allowing selection of a particular dart game by a player. A keypad switching matrix extends from the upper surface of the case and is formed with plurality of keys arranged in a configuration to resemble a dart board and with each of the keys sized to represent a specific scoring space on the dart board. Each key of the keypad switching matrix is actuateable by the player for transmitting a point value indicative of the scoring space on the dart board where a dart of the player impinged during the particular dart game. A computation mechanism is coupled to the game switch selection mechanism and the keypad switching matrix and with the computation mechanism receiving the point values attained during play to generate a score value. A display mechanism extends through the case and is coupled to the computation mechanism for displaying the score values of the player.

2 Claims, 3 Drawing Sheets

DART GAME ELECTRONIC SCOREKEEPING DEVICE

BACKGROUND OF THE INVENTION

1. Field of the Invention

The present invention relates to a dart game electronic scorekeeping device and more particularly pertains to tallying scores of a plurality of players during a game of darts with a dart game electronic scorekeeping device.

2. Description of the Prior Art

The use of dart board games is known in the prior art. More specifically, dart board games heretofore devised and utilized for the purpose of tallying scoring of dart games are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,454,276 to Brenkert et al. discloses a self-scoring dart game. U.S. Pat. No. 4,567,461 to Honekman et al. discloses an electronic dart game scoreboard. U.S. Pat. No. 4,852,888 to Ross et al. discloses an electrically scoring dart board. U.S. Pat. No. 4,955,967 to Houriet Jr. et al. discloses electronically scored dart game with missed dart detection system. U.S. Pat. No. 5,054,792 to Danielson discloses a dart game scoring system. U.S. No. Pat. No. 5,318,319 to Jones et al. discloses an electronic cricket dart game.

While these devices fulfill their respective, particular objective and requirements, the aforementioned patents do not describe a dart game electronic scorekeeping device that allows players' scores during a particular dart game to be automatically tallied when input through a switch matrix that resembles a dart board.

In this respect, the dart game electronic scorekeeping device according to the present invention substantially departs from the conventional concepts and designs of the prior art, and in doing so provides an apparatus primarily developed for the purpose of tallying scores of a plurality of players during a game of darts.

Therefore, it can be appreciated that there exists a continuing need for new and improved dart game electronic scorekeeping device which can be used for tallying scores of a plurality of players during a game of darts. In this regard, the present invention substantially fulfills this need.

SUMMARY OF THE INVENTION

In the view of the foregoing disadvantages inherent in the known types of dart board games now present in the prior art, the present invention provides an improved dart game electronic scorekeeping device. As such, the general purpose of the present invention, which will be described subsequently in greater detail, is to provide a new and improved dart game electronic scorekeeping device and method which has all the advantages of the prior art and none of the disadvantages.

To attain this, the present invention essentially comprises, in combination, a generally box-shaped housing. The housing has a planar lower surface, a planar upper surface, a lower compartment formed therein, and an upper compartment formed therein and with the upper compartment accessible through an opening formed on the upper surface. The housing further has a size that is readily transportable within a player's hand from one location to another. A rectangular case is included and disposed within the upper compartment of the housing. The case has a planar upper surface positionable flush with the upper surface of the housing and a periphery formed of a pair of opposed short side edges, a long upper edge, and a long lower edge removably hingeably coupled to the housing. The case further has a pair of retractable rectangular planar dart holders coupled to each side edge thereof. Each dart holder has a plurality of through holes formed thereon. The case additionally includes a plurality of through holes formed along the upper edge. The through holes on each dart holder and on the upper edge are sized to receive a tip end of a dart and to hold the dart in a set position. A game switch selection means is included and extended through the upper surface of the case for allowing selection of a particular dart game by one of the players. A player mode switch means is included and extended from the upper surface of the case for providing an indication of a number of players that will play the particular dart game. A keypad switching matrix is included and extended from the upper surface of the case. The keypad switching matrix is formed with plurality of keys arranged in a configuration to resemble a dart board. Each of the keys is sized to represent a different scoring space on the dart board. Each key of the keypad switching matrix is depressible by one of the players for transmitting a point value indicative of the scoring space on the dart board where a player's dart has impinged during a turn at play of the particular dart game. Electronic computation means are included and disposed within the lower compartment of the housing. The computation means are further coupled to the game switch selection means, the player mode switch means, and the keypad switching matrix. The computation means receives the point values attained by each of the players during play to generate a score value. The computation means further computes the values representing the point values required to effectively score out. The computation means further computes a value representing the total number of darts thrown. Interface means are included. The interface means are coupled to the computation means and coupleable to an external display device for transmitting the score values thereto for display. Display means are included and extended through the upper surface of the case. The display means are further coupled to the computation means for displaying the score values of each player. Speaker means are included and extended through the upper surface of the case. The speaker means are further coupled to the computation means. The speaker means is responsive to the computation means for providing an audible indication of point values being tallied. A manually-depressible game switch status means is included and extended from the upper surface of the case. The game switch status means is coupled to the computation means and has a depressed orientation that directs the computation means to provide a visual indication via the display means of the number of darts thrown. A manually-depressible score changing switch means extended is included and from the upper surface of the case. The score changing switch means is coupled to the computation means and has a depressed orientation that directs the computation means to allow for changes of score values of one of the players through the keypad switching matrix. A power supply means is included for supplying electrical power to the computation means, the display means, and the keypad switching matrix for their operation. A power switching means is included and coupled to the power supply means, the computation means, the display means, and the keypad switching matrix. The power switching means has one orientation for allowing delivery of electrical power and another orientation for preventing such delivery. A pair of telescopic arms are included and coupled between the case and the housing. The arms are extendable for allowing the upper surface of the case to be positioned at an angle with respect to the upper surface of the housing. The arms are further retractable for allowing the upper surface of the case to be positioned flush with the upper surface of the housing. Lastly, a sheet is affixed to the upper surface of the case that bears instructions on how to operate the scorekeeping device.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dart game electronic scorekeeping device which has all the advantages of the prior art dart board games and none of the disadvantages.

It is another object of the present invention to provide a new and improved dart game electronic scorekeeping device which may be easily and efficiently manufactured and marketed.

It is a further object of the present invention to provide a new and improved dart game electronic scorekeeping device which is of durable and reliable construction.

An even further object of the present invention is to provide a new and improved dart game electronic scorekeeping device which is susceptible of a low cost of manufacture with regard to both materials and labor, and which accordingly is then susceptible of low prices of sale to the consuming public, thereby making such a dart game electronic scorekeeping device economically available to the buying public.

Still yet another object of the present invention is to provide a new and improved dart game electronic scorekeeping device which provides in the apparatuses and methods of the prior art some of the advantages thereof, while simultaneously overcoming some of the disadvantages normally associated therewith.

Even still another object of the present invention is to provide a new and improved dart game electronic scorekeeping device for tallying scores of a plurality of players during a game of darts.

Lastly, it is an object of the present invention to provide a new and improved dart game electronic scorekeeping device including a case. The case has an upper surface and a periphery formed of a pair of opposed side edges, an upper edge, and a lower edge. A game switch selection mechanism is extended through the case for allowing selection of a particular dart game by a player. A keypad switching matrix extends from the upper surface of the case and is formed with plurality of keys arranged in a configuration to resemble a dart board and with each of the keys sized to represent a specific scoring space on the dart board. Each key of the keypad switching matrix is actuateable by the player for transmitting a point value indicative of the scoring space on the dart board where a dart of the player impinged during the particular dart game. A computation mechanism is coupled to the game switch selection mechanism and the keypad switching matrix and with the computation mechanism receiving the point values attained during play to generate a score value. A display mechanism extends through the case and is coupled to the computation mechanism for displaying the score values of the player.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
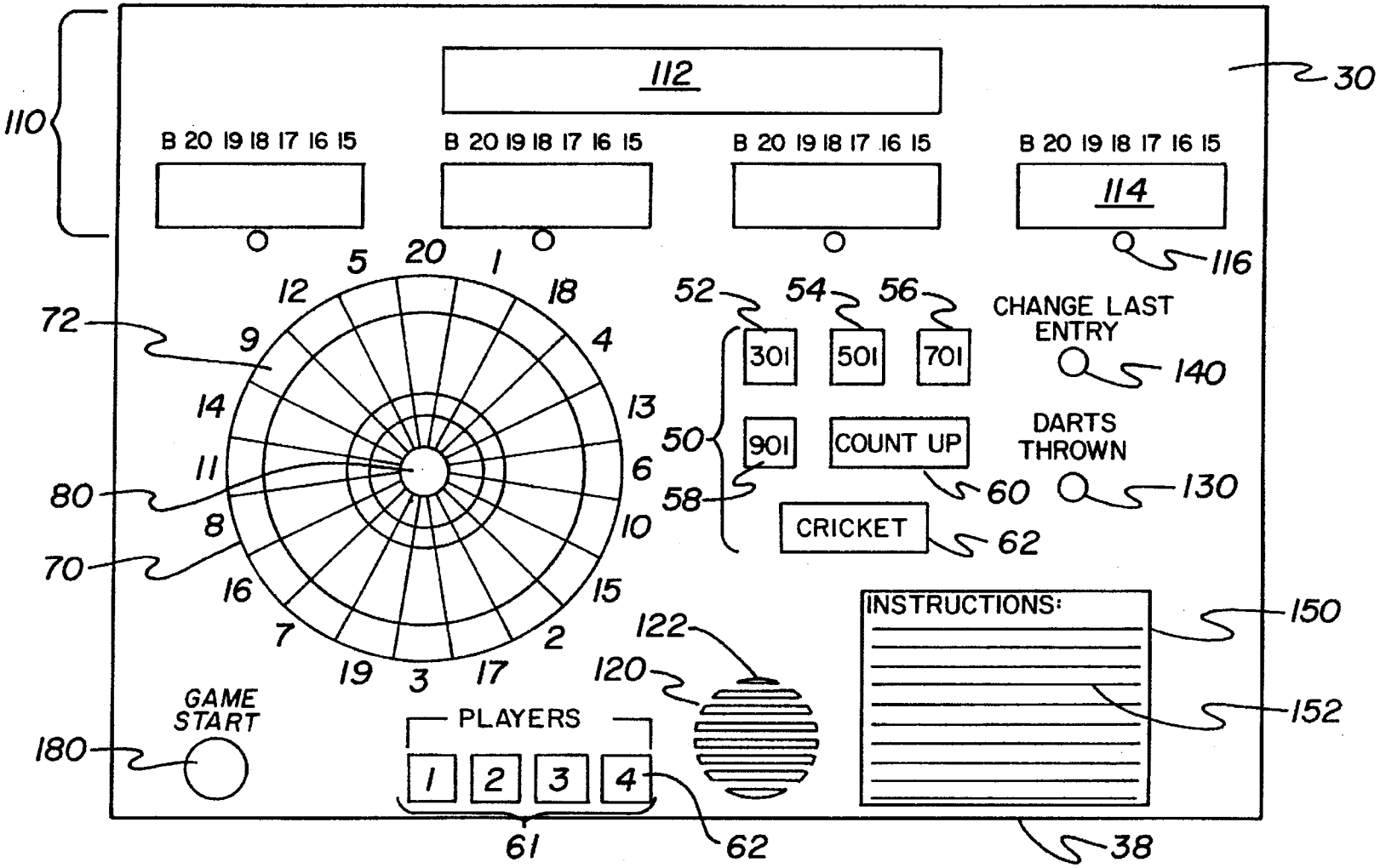
FIG. 1 is a plan view of the game board of the present invention.

With reference now to the drawings, and in particular, to FIG. 1 thereof, the preferred embodiment of the new and improved dart game electronic scorekeeping device embodying the principles and concepts of the present invention and generally designated by the reference number 10 will be described.

The preferred embodiment of the present invention comprises a plurality of components. In their broadest context, such components include a case with electronic circuitry emplaced in a housing. Such components are individually configured and correlated with respect to each other to provide a structure for tallying scores of a plurality of players during a game of darts and whose input device resembles a dart board.

Specifically, the present invention includes a housing 12. The housing is generally box-shaped and formed of a rigid material such as metal or plastic. The housing has a planar lower surface 14, a planar upper surface 16, and a lower compartment 18 formed therein. In addition, an upper compartment 20 is formed within the housing and is accessible through a rectangular opening 22 formed on the upper surface. The housing has a size that is readily transportable within a player's hand from one location to another.

Figure 2:
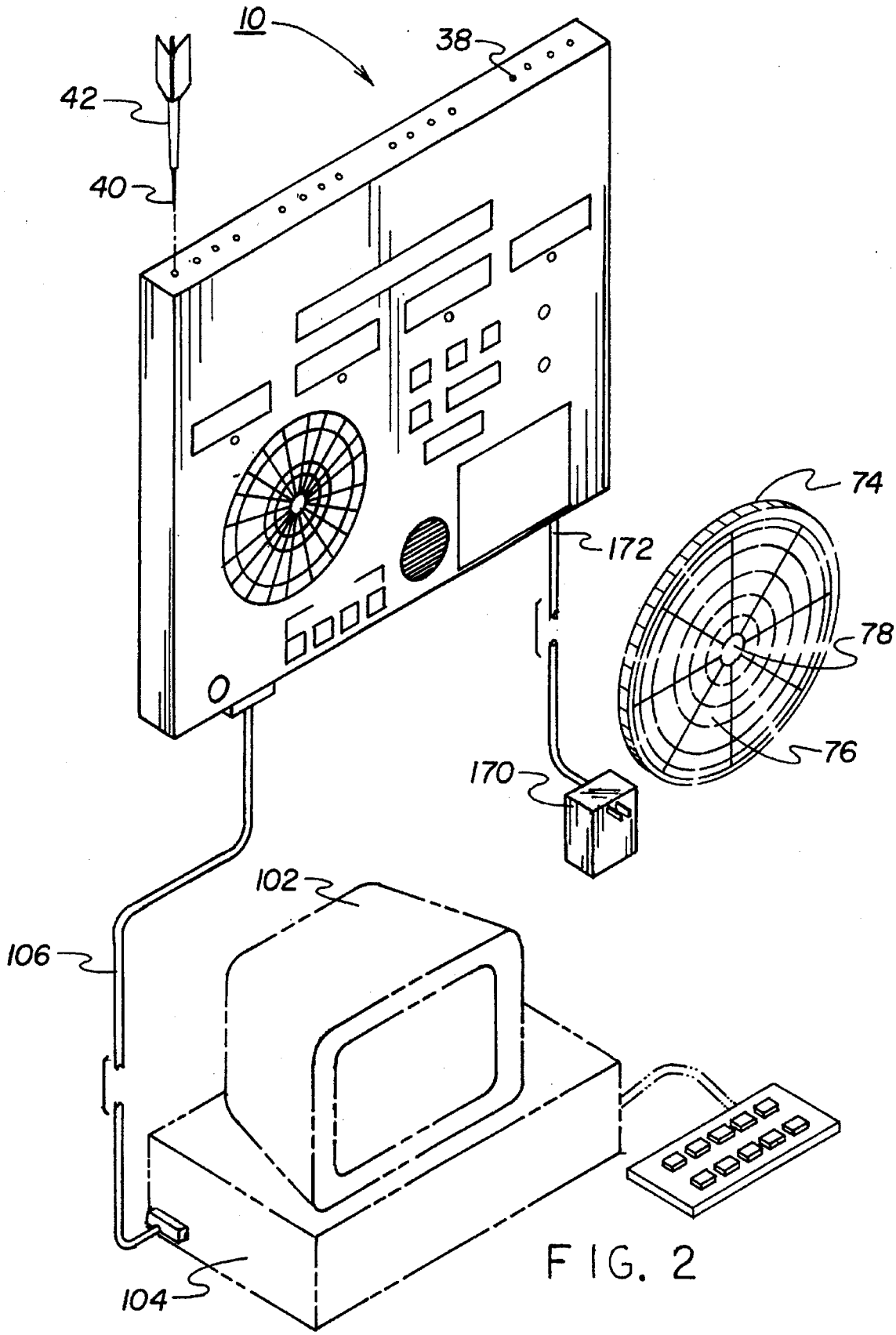
FIG. 2 is a perspective view of the preferred embodiment constructed in accordance with the principles of the present invention.
Figure 3:
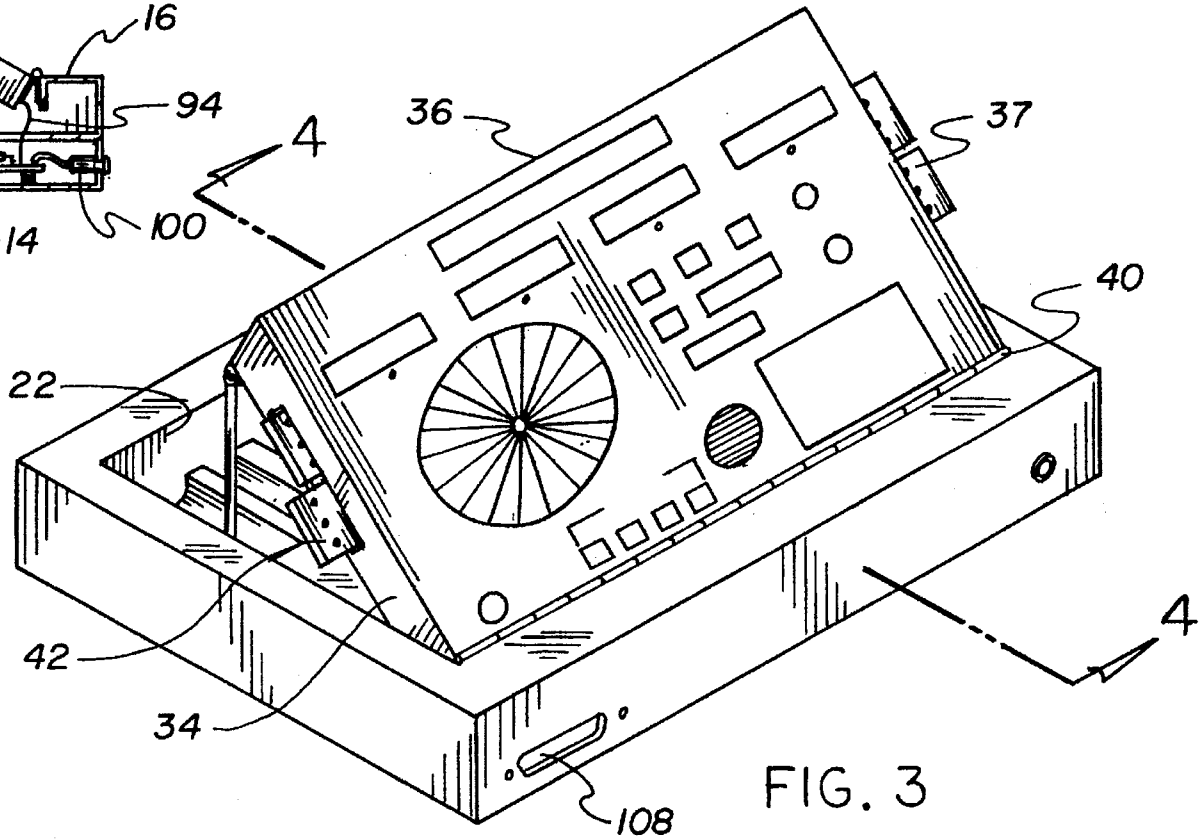
FIG. 3 is a perspective view of the game board in an extended configuration for use.
Figure 4:
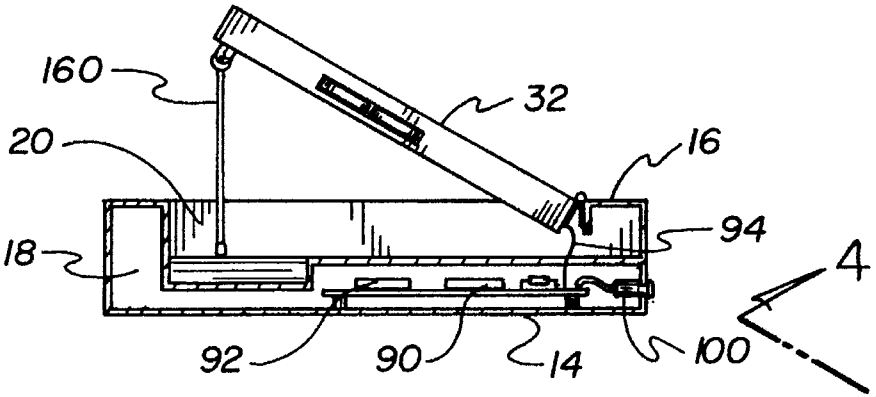
FIG. 4 is a cross-sectional view the present invention taken along the line 4—4 of FIG. 3.

Disposed within the upper compartment 20 of the housing 12 is a hollow rectangular case 30. The case is formed of a rigid material such as metal or plastic. The case has a planar upper surface 34 that is positionable flush with the upper surface 16 of the housing. The case also has a periphery formed of a pair of opposed short side edges 34, a long upper edge 36, and a long lower edge 38. The lower edge is removably secured to the housing 12 with a hinge 40. The hinge 40 allows the case to be removed from the housing such that it can be used in a wall-type configuration as shown in FIG. 2.

The case further has a pair of retractable rigid plastic planar rectangular dart holders 42. The dart holders are coupled to each side edge 34 of the case. Each dart holder has a plurality of spaced through holes 37 formed thereon. The case additionally includes a plurality of spaced through holes 38 formed along the upper edge. The through holes on each of the dart holders and on the upper edge of the case are sized to receive a tip end 40 of a dart 42 to thereby hold the dart in a set position. Thus, the darts in the set position then may be readily accessed for use.

An electrically energizeable circuit is also included. The circuit includes an electronic game switch selection mechanism 50. The game switch selection mechanism is extended through the upper surface 32 of the case. The game switch selection mechanism allows selection of a particular dart game by one of the players. Such dart games are of the conventional type. The present invention includes a first switch 52 for allowing selection of a game of "301", a second switch 54 for allowing selection of a game of "501", a third switch 56 for allowing selection of a game of "701", a fourth switch 58 for allowing selection of a game of "901", a fifth switch 60 for allowing selection of a game of "count up", and a sixth switch 62 for allowing selection of a game of "cricket". In addition, an electronic player mode switch mechanism 61 is extended from the upper surface 32 of the case. The player mode switch mechanism 61 provides an indication of a number of players that will play the particular dart game as selected through the game switch selection mechanism 50. In the preferred embodiment, four switches 62 are provided for allowing scores of up to four players to be tallied during a game. Other embodiments can accommodate fewer or greater numbers of players.

The circuit also includes an electronic keypad switching matrix 70. The keypad switching matrix is extended from the upper surface 32 of the case. The keypad switching matrix is formed with a plurality of rigid plastic keys 72 that are arranged in a configuration to resemble the scoring surface of a conventional dart board 74. Each of the keys 72 is sized to represent a different scoring space 76 on the dart board 74. Each key of the keypad switching matrix is depressible by one of the players for transmitting a point value indicative of the scoring space 76 on the dart board 74 where a player's dart 42 has impinged during a turn at play of the particular dart game. For example, if a player's dart impinges on the bull's eye 78 of the dart board 74, the bull's eye key 80 of the keypad switching matrix 70 is depressed by the player for tallying the score of the bull's eye. The other keys are used in a similar fashion. Each key 72 is formed in the shape of a sector of a circle with the exception of the bull's eye key, which is formed in the shape of a disk.

Disposed within the lower compartment 18 of the housing is an electronic computation mechanism 90. The computation mechanism is secured to a printed circuit board 92 and is formed of conventional electronic components and integrated circuits. The computation mechanism 90 is coupled to the game switch selection mechanism 50, the player mode switch mechanism 61, and the keypad switching matrix 70 with a line 94. The computation mechanism 90 receives the point values attained by each of the players during play as entered through the keypad switching matrix 70 to generate a score value indicative of the particular game being played. The computation mechanism also calculates the minimum combination of possible point values which sum to be less than or equal to 180 to be employed during a game of "301", "501", "701", or "901". The computation mechanism further computes a value representing the total number of darts thrown by the players during play of the particular game.

Additionally, an electronic interface mechanism 100 is included as part of the electric circuit and is coupled to the computation mechanism 90. The interface mechanism is further coupleable to an external display device such as a cathode ray tube 102 of a computer 104 through a cable 106. The interface mechanism transmits the score values from the computation mechanism 90 to the cathode ray tube 102 for display. The interface mechanism is accessible through a port 108 formed on the housing 12.

The electric circuit also includes an electronic display mechanism 110 positioned near the upper edge of the case. The display mechanism is extended through upper surface 32 of the case and coupled to the computation mechanism 90 through line 94. The display mechanism 110 is used for displaying the score values of each player during a game. The display mechanism includes a long panel 112. The long panel 112 displays the score of the each player when the game of "cricket" is played. Furthermore, the long panel 112 exhibits the lowest possible combination of point values that sum to be the score value when the score value is less than or equal to 180 hence cueing to the player which keys must be depressed in order to score out effectively in a game of "301", "501", "701", or "901". The display mechanism 110 also includes four short display panels 114. Specifically, the short display panels 114 are expressly designed for displaying score values of a player during the games of "301", "501", "701", "901", "count up", and "cricket". The display panels are of a conventional light emitting diode or liquid crystal type. In addition, the display mechanism 110 includes four indicator lights 116. Each indicator light is formed of a light emitting diode and is coupled below a short display panel 114. The indicator light is lit to thereby designate which short display panel 114 is active such that a player's score may be properly entered through the keypad switching matrix.

Extended toward the upper surface 32 of the case and through a grill 122 is an electronic speaker mechanism 120. The speaker mechanism is further positioned near the lower edge 38 of the case. The speaker mechanism is coupled to the computation mechanism 90 through line 94. The speaker mechanism is responsive to the computation mechanism 90 for providing an audible indication of point values being tallied. In addition, the speaker mechanism can be utilized for providing audible cues for controlling point score entry of players during a particular game.

A manually-depressible electronic game switch status mechanism 130 is provided and includes a button extended from the upper surface 32 of the case. The game switch status mechanism is coupled to the computation mechanism 90 through line 94. The button of the game switch status mechanism has a depressed orientation that directs the computation mechanism 90 to provide a visual indication via the long panel 112 of the display mechanism 110 of the number of darts thrown by the players during a game.

Furthermore, a manually-depressible electronic score changing switch mechanism 140 is provided and includes a button extended from the upper surface 32 of the case. The score changing switch mechanism is coupled to the computation mechanism 90 through line 94. The button of the score changing switch mechanism is depressible for directing the computation mechanism to allow for changes of score values of one of the players through the keypad switching matrix 70. Thus, if a player wishes to change his score, he first depresses the button on the score changing switch mechanism 140 and then enters a new score value for his last turn through the keypad switching matrix 70.

Electrical power is supplied to the computation mechanism 90 the display mechanism 110, and the keypad switching matrix 70 through a power supply mechanism 170. The power supply mechanism includes an alternating current to direct current transformer and a cable 172. The transformer is securable to a conventional household electrical wall receptacle for receiving electrical power therefrom. In addition, the electric circuit includes a power switching mechanism 180 coupled to the power supply mechanism 170, the computation mechanism 90, the display mechanism 110, and the keypad switching matrix 70. The power switching mechanism 180 includes a button extended through the upper surface 32 of the case. The button is depressible for allowing delivery of electrical power to the electric circuit for operation. The button has another orientation for preventing such delivery, thereby deactivating the electric circuit. In an alternate embodiment, the present invention can be operated off of battery power.

A pair of telescopic arms 160 is included. The arms are coupled between the upper corners of the case and the housing 12. The arms are extendable for allowing the upper surface 32 of the case to be positioned at an angle with respect to the upper surface of the housing. The arms are further retractable for allowing the upper surface 32 of the case to be positioned flush with the upper surface 16 of the housing. The telescopic arms 160 thus allows angular positioning of the case for the discretion of the user. Lastly, a paper sheet 150 is adhered to the upper surface 32 of the case. The sheet bears instructions 152 on how to operate the score keeping device 10. Other instructions such as how to play the particular games can also be provided.

The present invention provides an easy to use automatic scoring mechanism for scoring various games of darts. A score value may be entered by depressing a corresponding input key on the key mechanism. Games offered through the use of the present invention include the game of 301, 501, 701, 901, cricket, and count-up. The present invention keeps track of scores values of four players at a time. Instructions are included and displayed on the case for convenience. The present invention is fully portable. The case is adjustable through a pair of support arms. In addition, the present invention can be linked to a computer such as that used during large dart tournaments. The present invention can be formed in a table-top version, a wall mounted unit, or a hand-held unit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A dart game electronic scorekeeping device for tallying scores of a plurality of players during a game of darts comprising, in combination:

a generally box-shaped housing having a planar lower surface, a planar upper surface, a lower compartment formed therein, and an upper compartment formed therein and with the upper compartment accessible through an opening formed on the upper surface, the housing further having a size that is readily transportable within a player's hand from one location to another;

a rectangular case disposed within the upper compartment of the housing, the case having a planar upper surface positionable flush with the upper surface of the housing and a periphery formed of a pair of opposed short side edges, a long upper edge, and a long lower edge removably hingeably coupled to the housing, the case further having a pair of retractable rectangular planar dart holders coupled to each side edge thereof with each dart holder having a plurality of through holes formed thereon, the case additionally including a plurality of through holes formed along the upper edge and with the through holes on each dart holders and on the upper edge sized to receive a tip end of a dart and to hold the dart in a set position;

game switch selection means extended through the upper surface of the case for allowing selection of a particular dart game by one of the players;

player mode switch means extended from the upper surface of the case for providing an indication of a number of players that will play the particular dart game;

a keypad switching matrix extended from the upper surface of the case and formed with plurality of keys arranged in a configuration to resemble a dart board and each of the keys sized to represent a different scoring space on the dart board, each key of the keypad switching matrix depressible by one of the players for transmitting a point value indicative of the scoring space on the dart board where a player's dart impinged during a turn at play of the particular dart game;

computation means disposed within the lower compartment of the housing and coupled to the game switch selection means, the player mode switch means, and the keypad switching matrix and with the computation means receiving the point values attained by each of the players during play to generate a score value and with the computation means further computing the values representing the point values required for effectively scoring out and with the computation means further computing a value representing the total number of darts thrown;

interface means coupled to the computation means and coupleable to an external display device for transmitting the score values thereto for display;

display means extended through the upper surface of the case and coupled to the computation means for displaying the score values of each player;

speaker means extended through the upper surface of the case and coupled to the computation means and with the speaker means responsive to the computation means for providing an audible indication of point values being tallied;

manually-depressible game switch status means extended from the upper surface of the case and coupled to the computation means and with the game switch status means having a depressed orientation that directs the computation means to provide a visual indication via the display means of the number of darts thrown;

manually-depressible score changing switch means extended from the upper surface of the case and coupled to the computation means and with the score changing switch means having a depressed orientation that directs the computation means to allow for changes of score values of one of the players through the keypad switching matrix;

power supply means for supplying electrical power to the computation means, the display means, and the keypad switching matrix for their operation;

power switching means coupled to the power supply means, the computation means, the display means, and the keypad switching matrix and with the power switching means having one orientation for allowing delivery of electrical power and another orientation for preventing such delivery;

a pair of telescopic arms coupled between the case and the housing with the arms extendable for allowing the upper surface of the case to be positioned at an angle with respect to the upper surface of the housing and with the arms further retractable for allowing the upper surface of the case to be positioned flush with the upper surface of the housing; and a sheet affixed to the upper surface of the case that bears instructions on how to operate the scorekeeping device.

2. A dart game electronic scorekeeping device comprising:

a case having an upper surface and a periphery formed of a pair of opposed side edges, an upper edge, and a lower edge;

game switch selection means extended through the case for allowing selection of a particular dart game by a player;

a keypad switching matrix extended from the upper surface of the case and formed with plurality of keys arranged in a configuration to resemble a dart board and with each of the keys sized to represent a specific scoring space on the dart board, each key of the keypad switching matrix actuateable by the player for transmitting point values indicative of the scoring space on the dart board where a dart of the player impinged during the particular dart game;

computation means coupled to the game switch selection means and the keypad switching matrix and with the computation means receiving the point values attained by the player during play to generate score values; and display means extended through the upper surface of the case and coupled to the computation means for displaying the score values of the player;

a housing having a compartment formed therein and an opening for allowing access to the compartment;

the case being disposed within the compartment of the housing and removably hingeably coupled thereto; and arm extension means coupled between the case and the housing with the arm extension means extendable for allowing the case to be positioned at an angle with respect to the housing and with the arm extension means further retractable for allowing the case to be positioned within the compartment.

* * * * *